US005927842A

United States Patent [19]

Preisler

[11] Patent Number: 5,927,842

[45] Date of Patent: Jul. 27, 1999

[54] FLASHING AND SOUND GENERATING TIE

[76] Inventor: Leland Preisler, 11728 Goldring Rd., Arcadia, Calif. 91103

[21] Appl. No.: 09/050,195

[22] Filed: Mar. 30, 1998

[51] Int. Cl.[6] ..... F21L 15/08; F21L 7/00

[52] U.S. Cl. ..... 362/103; 362/108; 362/184; 362/800; 362/96; 362/191

[58] Field of Search ..... 362/103, 108, 362/189, 184, 800, 253, 157, 190, 96, 191; 2/151

[56] References Cited

U.S. PATENT DOCUMENTS

| | | | |
|---|---|---|---|
| 3,206,765 | 9/1965 | Sherman | 2/151 |
| 4,283,797 | 8/1981 | Seider | 362/108 |
| 5,836,670 | 11/1998 | Gilson | 362/103 |

*Primary Examiner*—Thomas M. Sember
*Attorney, Agent, or Firm*—David and Raymond; Raymond Y. Chan; David W. Lee

[57] ABSTRACT

A flashing and sound generating tie includes a tie and a flashing and sounding unit. The tie has a front surface which has at least a mounting hole provided thereon. The flashing and sounding unit includes a printed circuit board, at least a LED connected electrically to the printed circuit board and fitly penetrated through the mounting hole of the tie to outside, a sound element connected electrically thereto, a battery electrically connected with the printed circuit board for supplying electrical power for the LED and the sound element, and a power switch button electrically connected with and mount on the printed circuit board. The flashing and sound generating tie further includes an affixing means for detachably affixing the flashing and sounding unit on a front surface of the supporting lining and a holding means for firmly holding the LED in position at the mounting hole. Therefore, when the power switch button is pressed once, the LED and the sound element are activated to produce flash and sound respectively for a predetermined period of time.

8 Claims, 4 Drawing Sheets

FLASHING AND SOUND GENERATING TIE

BACKGROUND OF THE PRESENT INVENTION

The present invention relates to tie, and more particular to a flashing and sound generating tie which can produce flashing light and sound effect upon the wearer's activation.

During holidays such as Christmas or Halloween, celebrating people would purchase and wear all kinds of seasonal clothing and decorative article having specific figures or drawings provided thereon. Manufacturers may provide various printing designs on clothing but seldom of them can provide lighting or sounding effect.

It is well known that a small lighting bulb such as LED can provide flashing effect. However, the questions are where should the lighting device be mounted without affecting the outlook of the clothing and how can the lighting device be firmly included in the clothing structure.

Even though the manufacturers can solve the problem of affixing, it is another problem that whether it can be detached and re-installed when the clothing needs to be washed and cleaned. Construction cost and manufacturing cost is other essential factors to the manufacturers. In other words, if a manufacturer would like to produce a tie with flashing and sound generating effects, its components and production steps must be as less as possible.

SUMMARY OF THE PRESENT INVENTION

It is thus a first object of the present invention to provide a flashing and sound generating tie which can produce flashing light and sound effect upon the wearer's activation.

A further object of the present invention is to provide a flashing and sound generating tie having a flashing and sounding unit firmly mounted thereon in a fast and easy way.

Yet another object of the present invention is to provide a flashing and sound generating tie having a flashing and sounding unit which can be detached and re-installed easily when the tie needs to be washed or cleaned.

Still another object of the present invention is to provide a flashing and sound generating tie which has an inexpensive cost because of its economic components and production steps.

In order to accomplish the above objects, the present invention provides a flashing and sound generating tie which comprises a tie and at least a flashing and sounding unit.

The tie comprises a long piece of cotton or silk cloth which two longitudinal sides are sewed up to form a tubular tie structure having one arrow-shaped end wider than another arrow-shaped end. The tie further comprises a supporting lining made of a piece coarse cloth which is embraced inside the tubular tie structure so as to support the shape of the tubular tie structure. On a front surface of the tubular tie structure, at least a mounting hole is provided thereon. A circular sewing edge is formed around the mounting hole to avoid broken fabric from coming off.

The flashing and sounding unit comprises a printed circuit board having two battery holders to respectively hold two batteries on the printed circuit board. At least a LED is connected electrically to a front side of the printed circuit board. A sound element which is programmed with a predetermined voice or music is connected electrically to a back side of the printed circuit board. The two batteries are electrically connected with the printed circuit board for supplying electrical power for the LED and the sound element. A power switch button is electrically connected with and mount on the front side of the printed circuit board, wherein when the power switch button is pressed once, the LED will flash and the sound element will produce sound such as horror voice or music for a predetermined period of time.

An affixing means for detachably affixing the flashing and sounding unit on a front surface of the supporting lining, wherein the LED on the front side of the printed circuit board is fitly penetrated through the mounting hole provided on the front surface of the tubular tie structure to outside, so that the flashing and sounding unit is hidden inside the tie while the LED thereof is protruded outside for observation. A holding means for firmly holding the LED in position at the mounting hole so as to prevent the LED from drawing back inside the tie.

DETAILED DESCRIPTION OF THE PREFERRED EMBODIMENT

Figure 1:
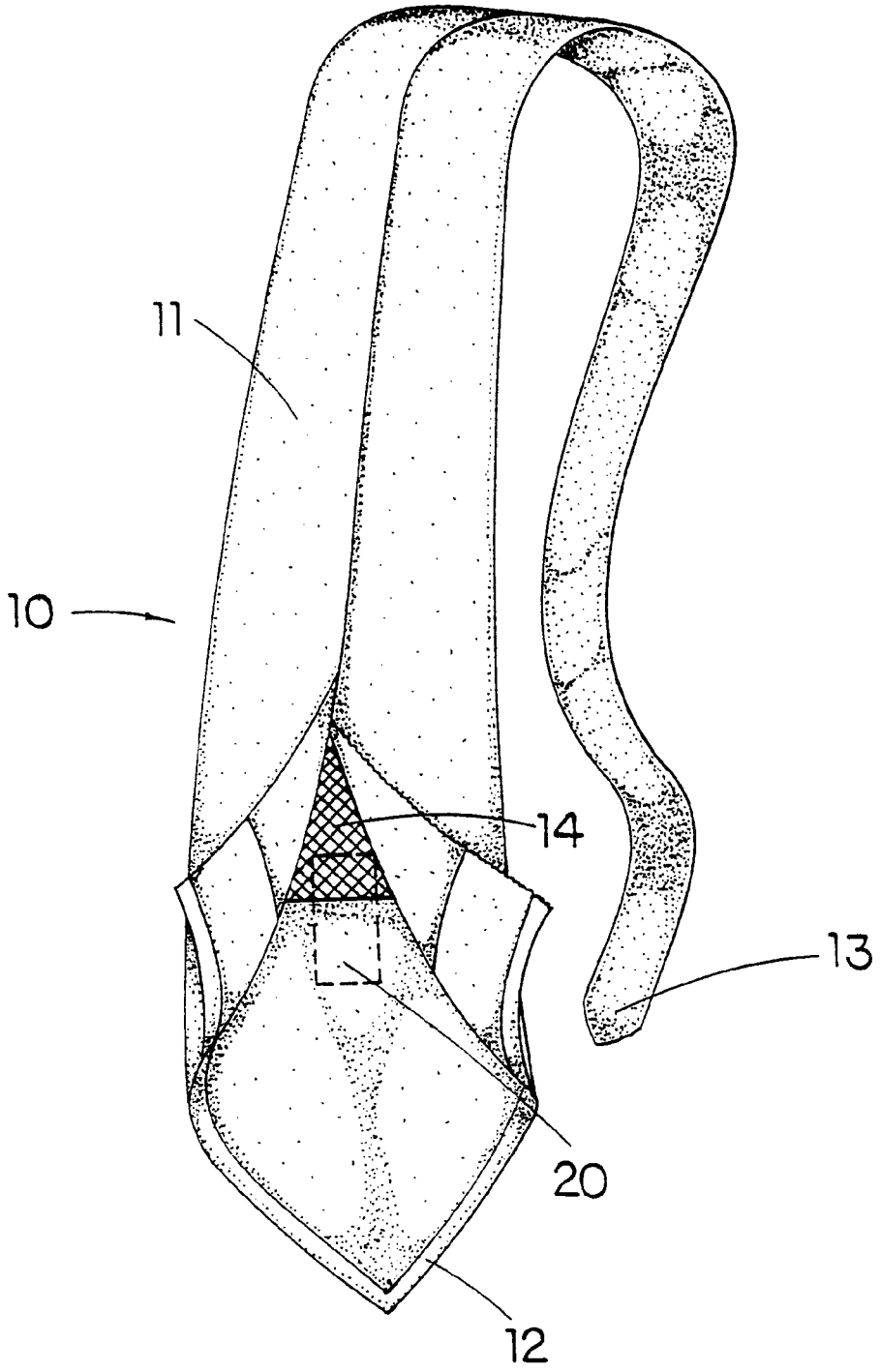
FIG. 1 is a rear perspective view of a flashing and sound generating tie in accordance with a preferred embodiment of the present invention.
Figure 2:
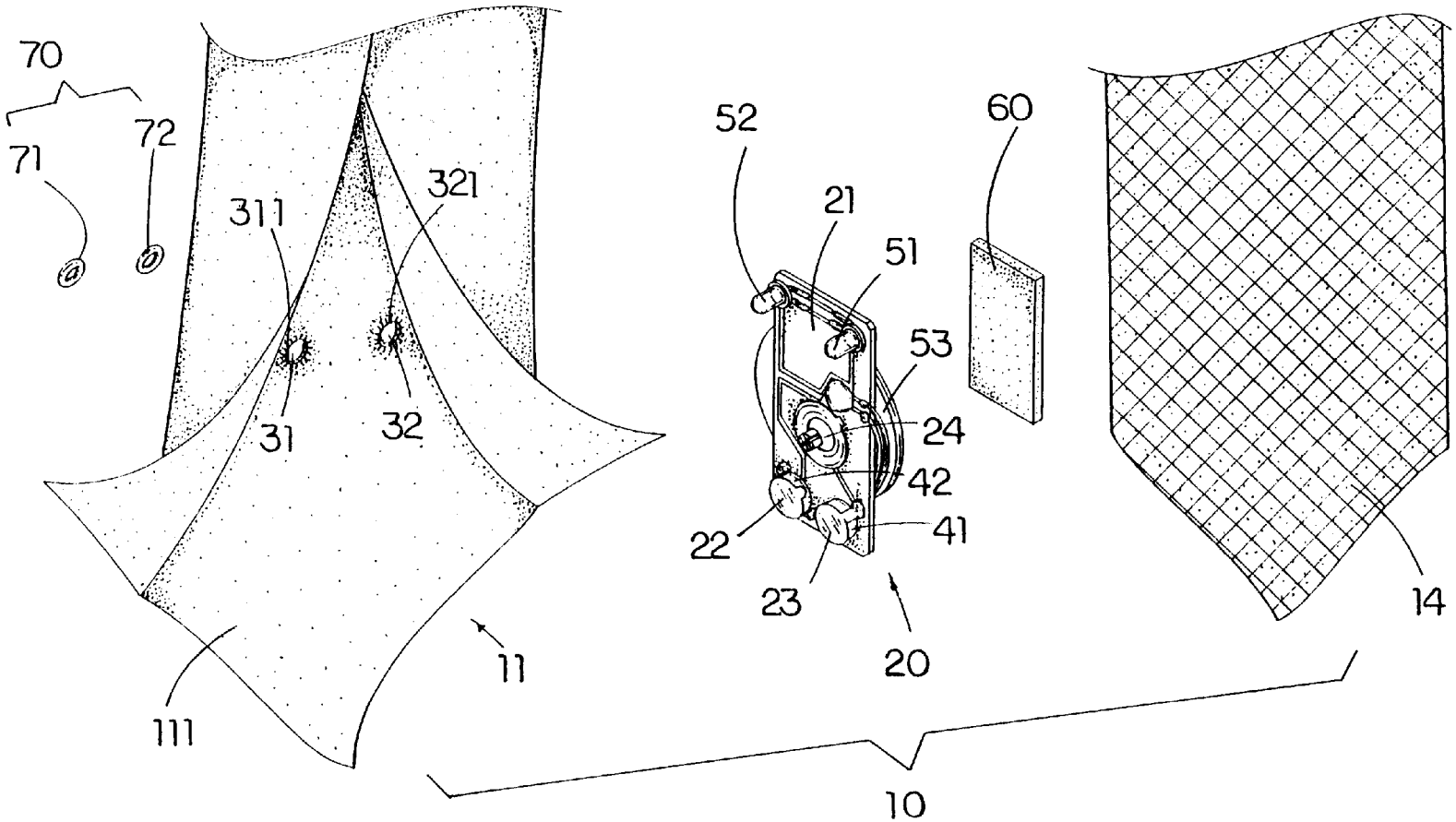
FIG. 2 is an exploded perspective view of the flashing and sound generating tie of the above preferred embodiment of the present invention.
Figure 3:
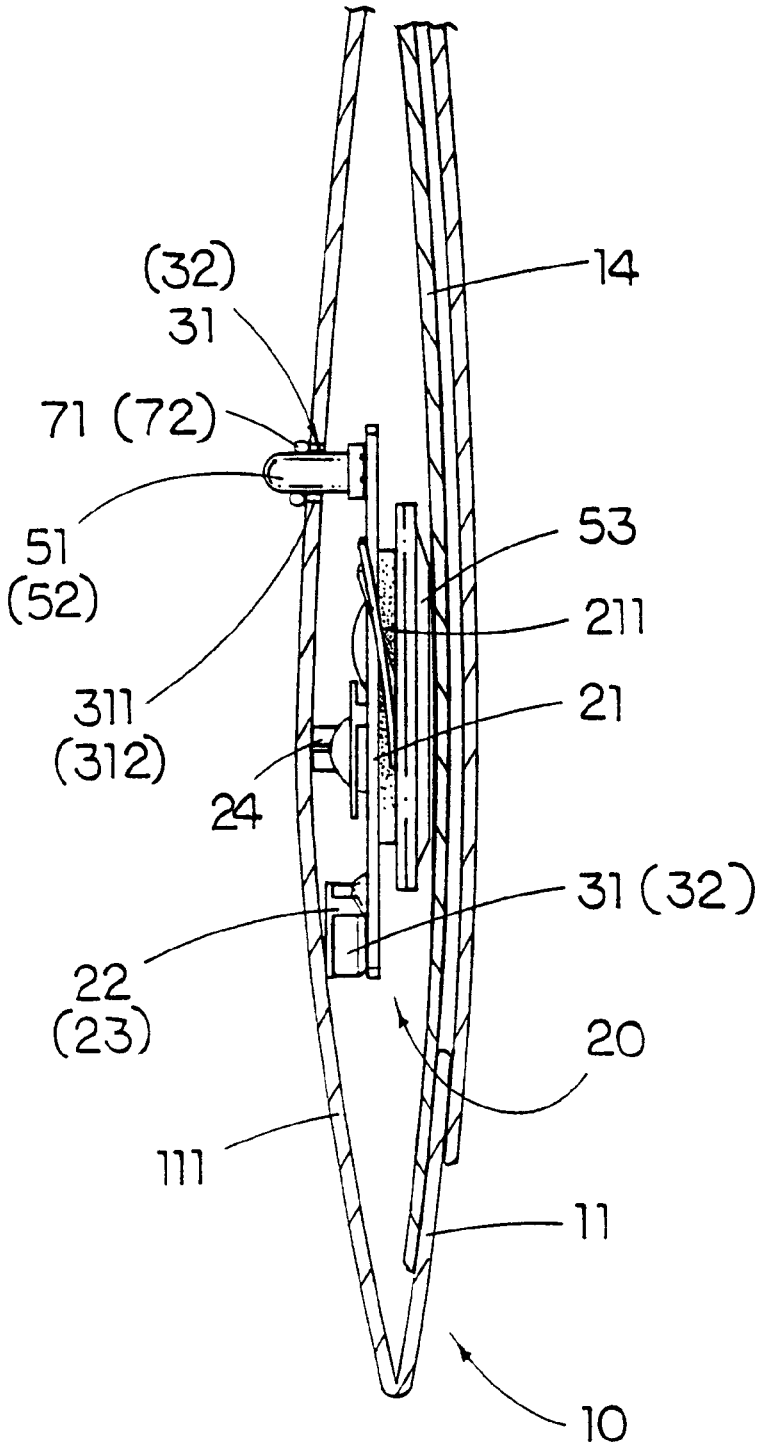
FIG. 3 is a sectional view of the flashing and sound generating tie of the above preferred embodiment of the present invention.

Referring to FIGS. 1 to 3, a flashing and sound generating tie comprises a tie 10 and at least a flashing and sounding unit 20. The tie 10 comprises a long piece of cotton or silk cloth which two longitudinal sides are sewed up to form a tubular tie structure 11 having one arrow-shaped end 12 wider than another arrow-shaped end 13. The tie further comprises a supporting lining 14 made of a piece coarse cloth which is embraced inside the tubular tie structure 11, as shown in FIG. 1, so as to support the shape of the tubular tie structure 11. On a front surface 111 of the tubular tie structure 11, two mounting holes 31, 32 is provided thereon. A circular sewing edge 311, 312 is formed around each of the mounting holes 31, 32 to avoid broken fabric from coming off.

The flashing and sounding unit 20 comprises a printed circuit board 21 having two battery holders 22, 23 to respectively hold two batteries 41, 42 on a bottom portion of the printed circuit board 21. Two LEDs 51, 52 are connected electrically to a top portion of a front side of the printed circuit board 21. A sound element 53, which is programmed with a predetermined voice or music, is connected electrically to a back side of the printed circuit board 21 by means of a double sides sticker pad 211, as shown in FIG. 3. The two batteries 31, 32 are electrically connected with the printed circuit board 21 for supplying electrical power for the LEDs 51, 52 and the sound element 53. A power switch button 24 is electrically connected with and mount on the front side of the printed circuit board 21, wherein when the power switch button 24 is pressed once, the LEDs 51, 52 are activated to produce flash and the sound element 53 is activated to produce sound such as horror voice or music for a predetermined period of time.

One of the essential parts of the present invention is how to structural incorporate with the tie 10. According to the present invention, the flashing and sound generating tie further comprises an affixing means for detachably affixing the flashing and sounding unit 20 on a front surface of the supporting lining, wherein the LEDs 51, 52 on the front side of the printed circuit board 21 is fitly penetrated through the mounting holes 31, 32 provided on the front surface 111 of the tubular tie structure 11 to outside, so that the flashing and sounding unit 20 is hidden inside the tie 10 while the LEDs 51, 52 thereof is protruded outside for observation. In accordance with the preferred embodiment, the affixing means comprises a double-side sticker pad 60 which one side is stuck onto a back surface of the printed circuit board 21 or directly onto the sound element 53 while the other side of the double-side sticker pad 60 is adhered on the front side of the supporting lining 14.

Another problem appears that the two LEDs 51, 52 penetrated through the two mounting holes 31, 32 would easily draw back inside the tie 10 if they fail to firmly hold in position. Therefore, the flashing and sound generating tie must further comprises a holding means 70 for firmly holding the two LEDs 51, 52 in position at the two mounting holes 31, 32 respectively so as to prevent the LEDs 51, 52 from drawing back inside the tie 10.

Because of the soft nature of the cloth, it is very difficult to install the conventional holding device on the cloth tie 10. Moreover, in order to reduce the cost of the flashing and sound generating tie of the present invention as much as possible, it is even more difficult to seek a kind of holder or holding device adapted to be used for holding the two LEDs 51, 52 in position. The present invention solves the above difficulties by means of two elastic rubber rings. In other words, the holding means 70 of the present invention comprises two elastic rings 71, 72, wherein each of the elastic rings 71, 72 has an inner diameter slightly smaller than a diameter of each of the two LEDs 51, 52. As shown in FIGS. 2 and 3, the two elastic rings 71, 72 are respectively slipped on the two LEDs 51, 52 until the two elastic rings 71, 72 pressed on the front surface 111 of the tubular tie structure 11, so that the front surface 111 of the tubular structure 11 is pressed and placed between the two elastic rings 71, 72 and the printed circuit board 21. Since the two elastic rings 71, 72 are tightly slipped on the two LEDs 51, 52 respectively, the two LEDs 71, 72 are thus firmly held in position to prevent drawing back. It is the cheapest and most effective way to detachably affix the two LEDs 51, 52 in position.

In view of the above embodiment, the flashing and sound generating tie of the present invention can produce flashing light and sound effect upon the wearer's activation by means of a flashing and sounding unit which is firmly mounted inside the tie in a fast and easy way. The flashing and sound generating tie has an inexpensive cost because of its economic components and lessened production process. Moreover the flashing and sounding unit can be detached and re-installed easily when the tie needs to be washed or cleaned.

Figure 4:
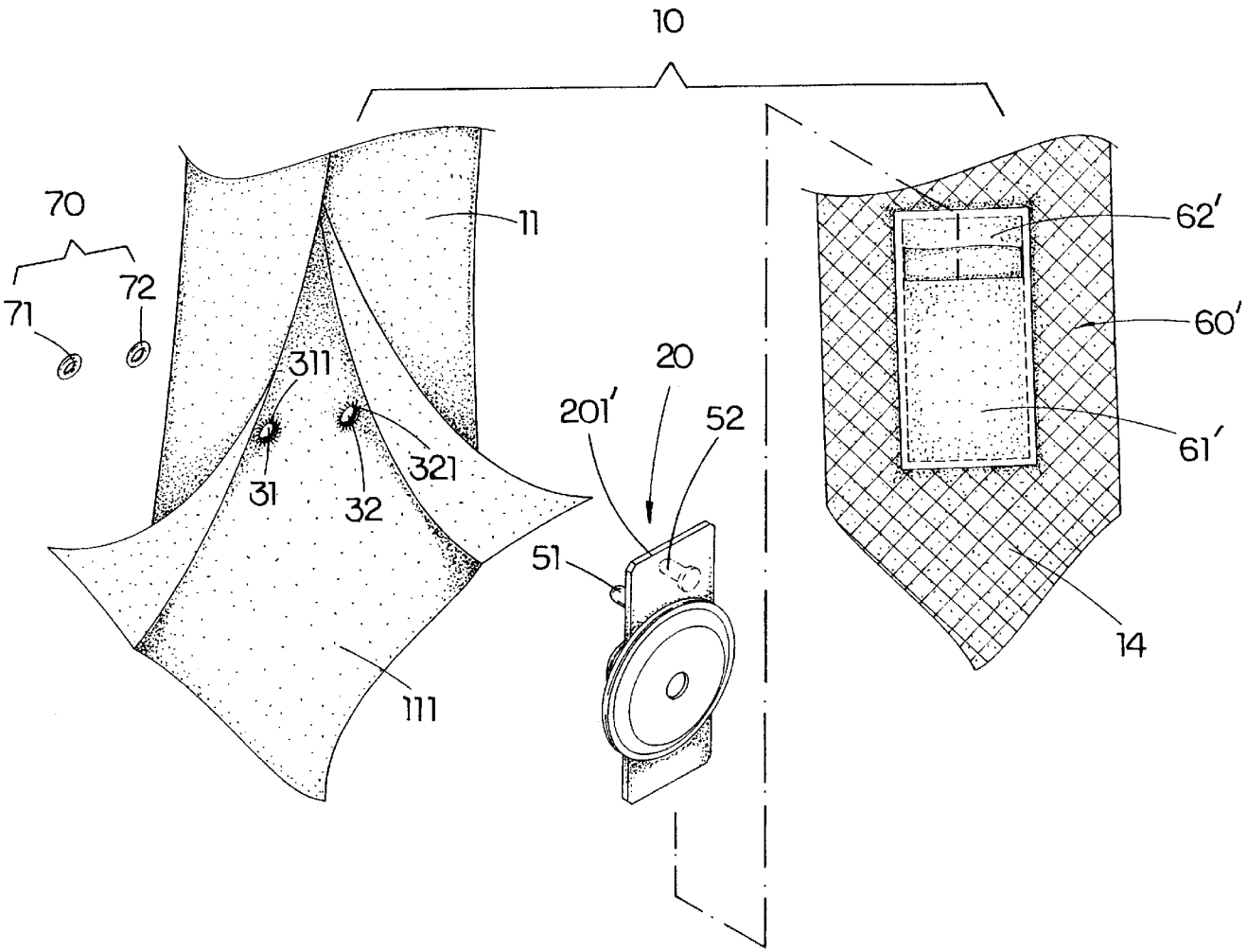
FIG. 4 is an exploded perspective view of an alternative mode of the flashing and sound generating tie of the above preferred embodiment of the present invention.

Referring to FIG. 4, an alternative mode of the above embodiment is illustrated, which has an identical structure of the above embodiment except the affixing means 60'. The affixing means 60' of this alternative mode comprises a pocket 61' having a top opening sewed onto the supporting lining 14. The flashing and sounding unit 20 is inserted into the pocket 61' so as to affix its position on the supporting lining 14. Moreover, in order to further hold the flashing and sounding unit 20 firmly in position, a top edge 201' is extended upwardly from the printed circuit board 21 and the affixing means 60' further comprises a top cover 62' sewed at a position right above the pocket 61' on the supporting lining, so that the top edge 201' of the flashing and sounding unit 20, which is received inside the pocket 61', can also be inserted into the top cover 62' so as to prevent the flashing and sounding unit 20 from dropping out of the pocket 61' even when the tie 10 is turned up side down.

What is claimed is:

1. A flashing and sound generating tie, comprising a tie which comprises a long piece of cloth which two longitudinal sides are sewed up to form a tubular tie structure having one arrow-shaped end wider than another arrow-shaped end, a supporting lining which is made of a piece coarse cloth and is embraced inside said tubular tie structure so as to support said tubular tie structure, said tubular tie structure having a front surface which has at least a mounting hole provided thereon, a circular sewing edge is formed around said mounting hole to avoid broken fabric from coming off;

a flashing and sounding unit which comprises a printed circuit board which has at least a battery holder to hold a battery on a bottom portion of said printed circuit board, at least a LED which is connected electrically to a top portion of a front side of said printed circuit board, and a sound element which is programmed with a predetermined voice or music and is connected electrically to said printed circuit board, wherein said battery is electrically connected with said printed circuit board for supplying electrical power for said LED and said sound element, and that a power switch button is electrically connected with and mount on said front side of said printed circuit board, wherein when said power switch button is pressed once, said LED and said sound element are activated to produce flash and sound respectively for a predetermined period of time;

an affixing means for detachably affixing said flashing and sounding unit on a front surface of said supporting lining, wherein said LED on said front side of said printed circuit board is fitly penetrated through said mounting hole provided on said front surface of said tubular tie structure to outside, so that said flashing and sounding unit is hidden inside said tie while said LED thereof is protruded outside for observation; and a holding means for firmly holding said LED in position at said mounting hole so as to prevent said LED from drawing back inside said tie, wherein said holding means comprises at least an elastic ring which has an inner diameter slightly smaller than a diameter of said LED and is slipped on said LED until said elastic ring pressing on said front surface of said tubular tie structure, so that said front surface of said tubular structure is pressed and placed between said elastic ring and said printed circuit board.

2. A flashing and sound generating tie, as recited in claim 1, wherein said sound element is attached to a back side of said printed circuit board by means of a double sides sticker pad.

3. A flashing and sound generating tie, as recited in claim 2, wherein said affixing means comprises a double-side sticker pad which one side is stuck onto said sound element while another side of said double-side sticker pad is adhered on said front side of said supporting lining.

4. A flashing and sound generating tie, as recited in claim 2, wherein said affixing means comprises a pocket having a top opening sewed onto said supporting lining, and that said flashing and sounding unit is inserted into said pocket.

5. A flashing and sound generating tie, as recited in claim 4, wherein said printed circuit board further has a top edge upwardly extended therefrom and said affixing means further comprises a top cover sewed at a position right above said pocket on said supporting lining, in which said top edge of said flashing and sounding unit is inserted into said top cover so as to prevent said flashing and sounding unit from dropping out of said pocket when said tie is turned up side down.

6. A flashing and sound generating tie, as recited in claim 1, wherein said affixing means comprises a double-side sticker pad which one side is stuck onto said sound element while another side of said double-side sticker pad is adhered on said front side of said supporting lining.

7. A flashing and sound generating tie, as recited in claim 1, wherein said affixing means comprises a pocket having a top opening sewed onto said supporting lining, and that said flashing and sounding unit is inserted into said pocket.

8. A flashing and sound generating tie, as recited in claim 7, wherein said printed circuit board further has a top edge upwardly extended therefrom and said affixing means further comprises a top cover sewed at a position right above said pocket on said supporting lining, in which said top edge of said flashing and sounding unit is inserted into said top cover so as to prevent said flashing and sounding unit from dropping out of said pocket when said tie is turned up side down.

* * * * *